US008300874B2

(12) United States Patent
Winter

(10) Patent No.: US 8,300,874 B2
(45) Date of Patent: Oct. 30, 2012

(54) LOUDSPEAKER HAVING ADJUSTABLE MAGNET

(76) Inventor: James F Winter, Gloucester Point, VA (US)

( * ) Notice: Subject to any disclaimer, the term of this patent is extended or adjusted under 35 U.S.C. 154(b) by 490 days.

(21) Appl. No.: 12/487,699

(22) Filed: Jun. 19, 2009

(65) Prior Publication Data

US 2010/0322459 A1 Dec. 23, 2010

(51) Int. Cl.
*H04R 25/00* (2006.01)

(52) U.S. Cl. ..... 381/412; 381/418

(58) Field of Classification Search ..... 381/162, 381/165, 412, 417, 418, 432, 420, 182, 411, 381/414; 310/13; 335/228, 229
See application file for complete search history.

(56) References Cited

U.S. PATENT DOCUMENTS

| | | | | |
|---|---|---|---|---|
| 4,000,381 | A * | 12/1976 | Plice et al. | 381/418 |
| 5,533,134 | A | 7/1996 | Tokura et al. | |
| 5,537,482 | A | 7/1996 | Janning | |
| 5,596,311 | A | 1/1997 | Bess et al. | |
| 5,809,157 | A * | 9/1998 | Grumazescu | 381/412 |
| 6,307,287 | B1 | 10/2001 | Garrett et al. | |
| 6,584,209 | B1 | 6/2003 | Wang | |
| 6,778,677 | B2 * | 8/2004 | Coffin | 381/418 |
| 7,142,685 | B2 | 11/2006 | Barnes | |

FOREIGN PATENT DOCUMENTS

EP 1487235 A2 12/2004

* cited by examiner

*Primary Examiner* — Huyen D Le
(74) *Attorney, Agent, or Firm* — Kilpatrick Townsend & Stockton LLP

(57) ABSTRACT

Loudspeakers are provided that include a moveable magnet that can be positioned relative to the speaker piston. A user of the loudspeaker may position the moveable magnet to achieve a desired tone, distortion, or other sound without requiring the loudspeaker to be operated at an undesirable sound pressure level. The loudspeaker may include an indicator showing the relative position of the magnet relative to the piston to the user.

19 Claims, 4 Drawing Sheets

LOUDSPEAKER HAVING ADJUSTABLE MAGNET

BACKGROUND OF THE INVENTION

A loudspeaker is a device for converting electrical signals or impulses into sound. A typical loudspeaker includes a coil of wire wrapped around a piston that is surrounded by a fixed permanent magnet. When a varying electrical signal is applied to the coil of wire, the piston moves axially, typically front-to-back relative to the loudspeaker, within the permanent magnet. A speaker cone (diaphragm) is attached to and moves with the piston. Movement of the cone produces sound according to the frequency and amplitude of the applied current.

Different sizes and configurations of loudspeakers are used to achieve different efficiency levels (sound power output relative to driving electrical power input), frequency response, and speaker size. The specific characteristics of a given loudspeaker often are selected based the expected use of the speaker. For example, in a public address loudspeaker a relatively low distortion at high sound pressure level (SPL) may be required, whereas a relatively poor frequency response may be acceptable. Other configurations and characteristics may be more suited for other applications and locations.

BRIEF SUMMARY OF THE INVENTION

Loudspeakers according to embodiments of the invention may include a magnet moveable relative to the speaker piston.

In an embodiment, a loudspeaker may include an enclosure, a speaker cone disposed at least partially within the enclosure, an outer magnet, and a piston connected to the speaker cone and disposed at least partially within the outer magnet. The outer magnet may be moveable, such as from a first position in which a first portion of the piston is disposed within the outer magnet, to a second position in which a second portion of the piston is disposed within the outer magnet, where the second portion is less than the first portion.

In an embodiment, the loudspeaker may include an indicator to identify the position of the magnet relative to the piston to a user of the device.

In an embodiment, the outer magnet is positionable in each of a plurality of pre-set positions. The magnet may be disposed within an assembly, which may include a plurality of stops corresponding to the pre-set positions. The outer magnet may be threaded, and disposed within a threaded assembly, allowing an operator of the device to rotate the magnet to position the magnet in a desired position.

In an embodiment, a loudspeaker may include a speaker body, a speaker cone disposed at least partially within the speaker body, a cylindrical magnet disposed adjacent to the narrow end of the speaker cone, which is moveable relative to a piston connected to the narrow end of the speaker cone such that a first portion of the piston is disposed within the cylindrical magnet when the cylindrical magnet is in the first position, and a second portion of the piston is disposed within the cylindrical magnet when the cylindrical magnet is in the second position, and an indicator moveably connected to the cylindrical magnet to show the position of the magnet to an operator of the loudspeaker.

Additional features, advantages, and embodiments of the invention may be set forth or apparent from consideration of the following detailed description, drawings, and claims. Moreover, it is to be understood that both the foregoing summary of the invention and the following detailed description are exemplary and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of the specification. No attempt is made to show structural details of the invention in more detail than may be necessary for a fundamental understanding of the invention and various ways in which it may be practiced. It will be understood that, unless indicated specifically to the contrary, the drawings may not be drawn to scale.

DETAILED DESCRIPTION OF THE INVENTION

Figure 1:
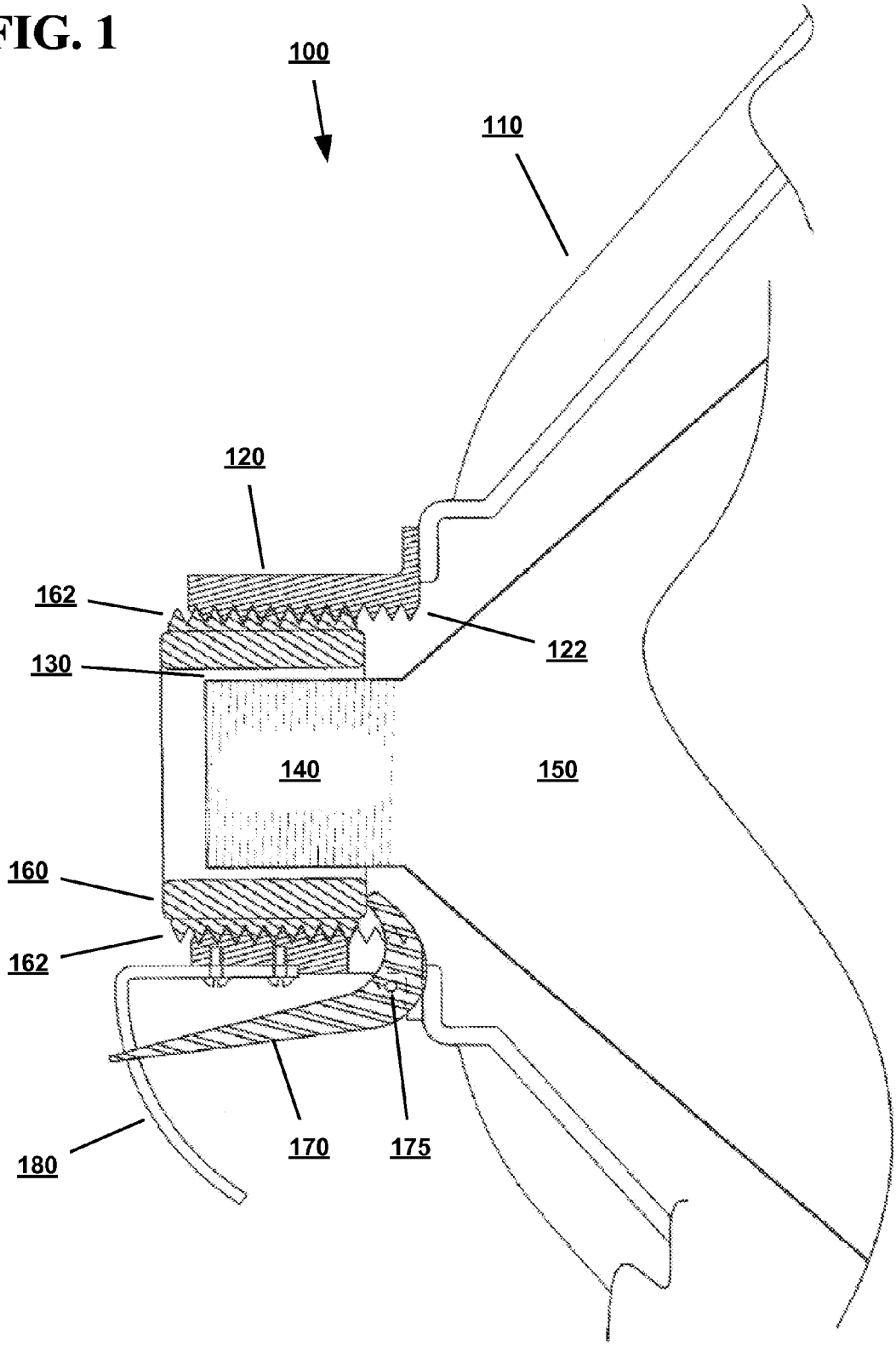
FIG. 1 shows a schematic side view of an example loudspeaker having a moveable magnet and a magnet position indicator.

One problem with conventional loudspeakers is that they may produce noticeably different types of sound when used at different volumes. For example, at a lower volume a guitar amplifier (i.e., a combination amplifier and loudspeaker) may produce a clean, thin tone. Such a sound may be appropriate for use with certain styles of music, but less suited or undesirable for other styles. For example, such a sound may be desirable or appropriate for use with classical or instrumental styles. For other styles of music, a warmer and/or more distorted sound may be desirable. Typically, this is achieved by increasing the volume at which the loudspeaker or combination amplifier/loudspeaker is operated, to a level that produces the desired effect. However, such a volume increase may be undesirable for other reasons, such as where the loudspeaker is used in a relatively small area. Various terms and terminology may be used to describe the tone produced by a loudspeaker. For example, tones produced by different loudspeakers may be referred to as full, rich, smooth, clean, dark, and other terms. The meaning of these and other terms used to describe loudspeaker tone will be readily understood by one of skill in the art.

Surprisingly, it has been found that the effective volume of a loudspeaker may be changed without affecting the tone produced by the loudspeaker by changing the position of the magnet in the loudspeaker relative to the piston. As the magnet is moved out, i.e., so that less of the coil is surrounded by the magnet, the sound pressure level of the loudspeaker is decreased, while leaving the tone and distortion of the loudspeaker relatively or entirely unaffected. That is, the loudspeaker may be operated to produce a desired tone and distortion, while the sound pressure level produced by the loudspeaker and, therefore, the actual volume heard by a listener, may be different than what would typically be required to achieve the selected tone distortion, or both ("tone/distortion").

To allow a loudspeaker operator to select a desired combination of a sound pressure level produced by a loudspeaker and the tone/distortion produced by the loudspeaker, loudspeakers as described herein may include a moveable magnet. The magnet may be moveable relative to the piston internal to the loudspeaker. In an example configuration, the magnet may be disposed within a threaded assembly such that as the magnet is rotated it moves axially relative to the piston. In other configurations, the magnet may be moved by sliding, and may include various preset or configurable slot positions that place the magnet into specific configurations relative to the piston. More generally, the magnet may be disposed around the piston in any configuration that allows the magnet to be moved from one position to another, but substantially prevents the magnet from moving while the loudspeaker is in use due to, for example, vibration of the loudspeaker.

As a specific example, a specific loudspeaker may produce a desired tone and distortion when operated at a relatively high volume setting. An operator of the loudspeaker may wish to achieve the same tone and/or distortion, but when operating at a lower volume setting, i.e., to achieve a lower sound pressure level. Such a situation may arise, for example, when a performer having a loudspeaker suited for performance in a relatively large or noisy venue, such as an arena, nightclub, rock venue, wishes to perform in a smaller or less noisy location, such as an auditorium, small club, or church. Typically, the performer would operate the loudspeaker at a lower volume, thus sacrificing some of the desired tone and/or distortion. However, according to embodiments of the present invention, it has been found that a loudspeaker with a moveable magnet may allow the loudspeaker to be used in a configuration that produces the desired tone and/or distortion but at a lower sound pressure level. Such a result may be achieved, for example, by positioning the magnet so that less of the piston is disposed within the interior region of the magnet.

Figure 2:
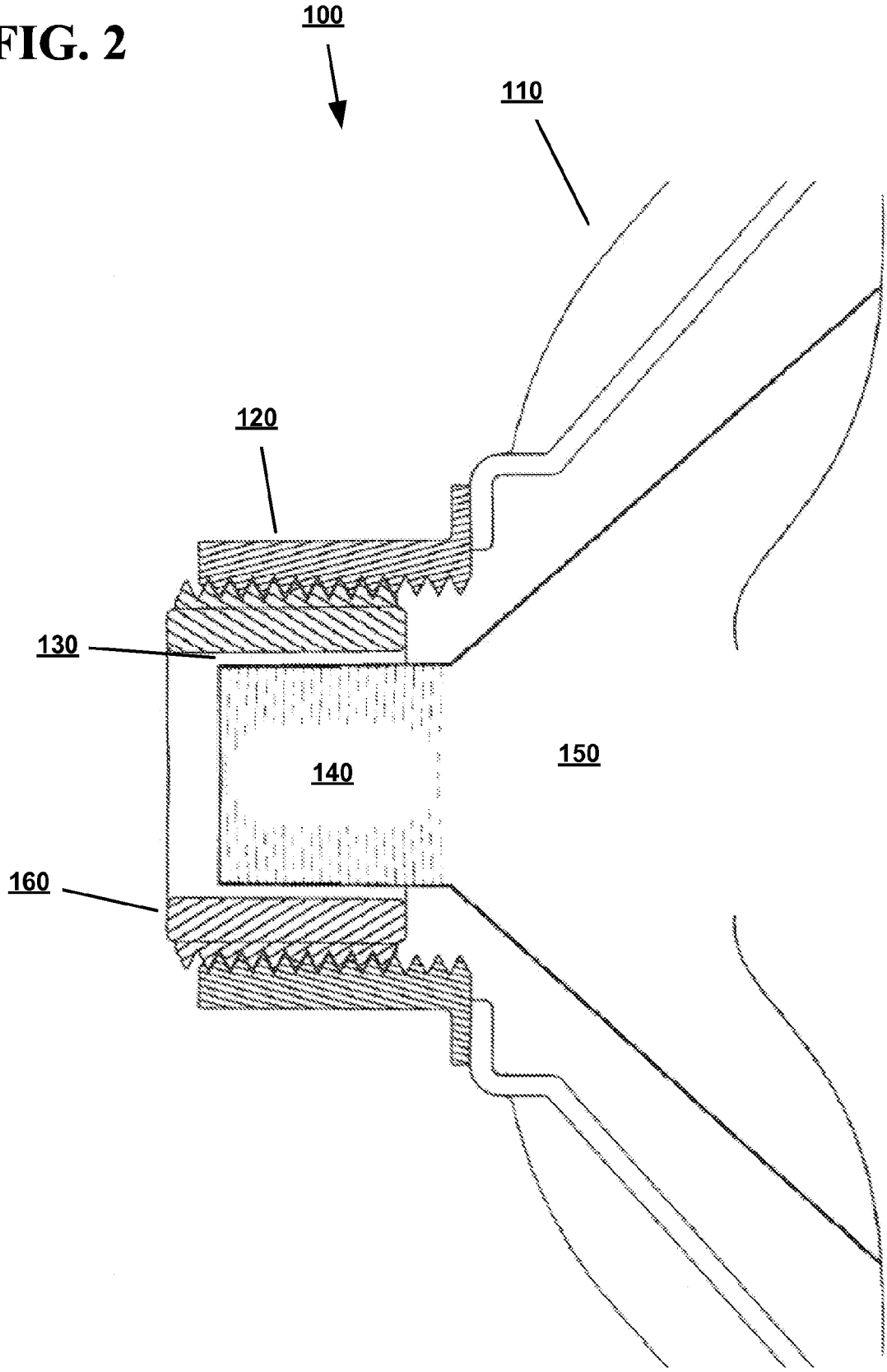
FIG. 2 shows a schematic side view of an example loudspeaker having a moveable magnet.
Figure 3:
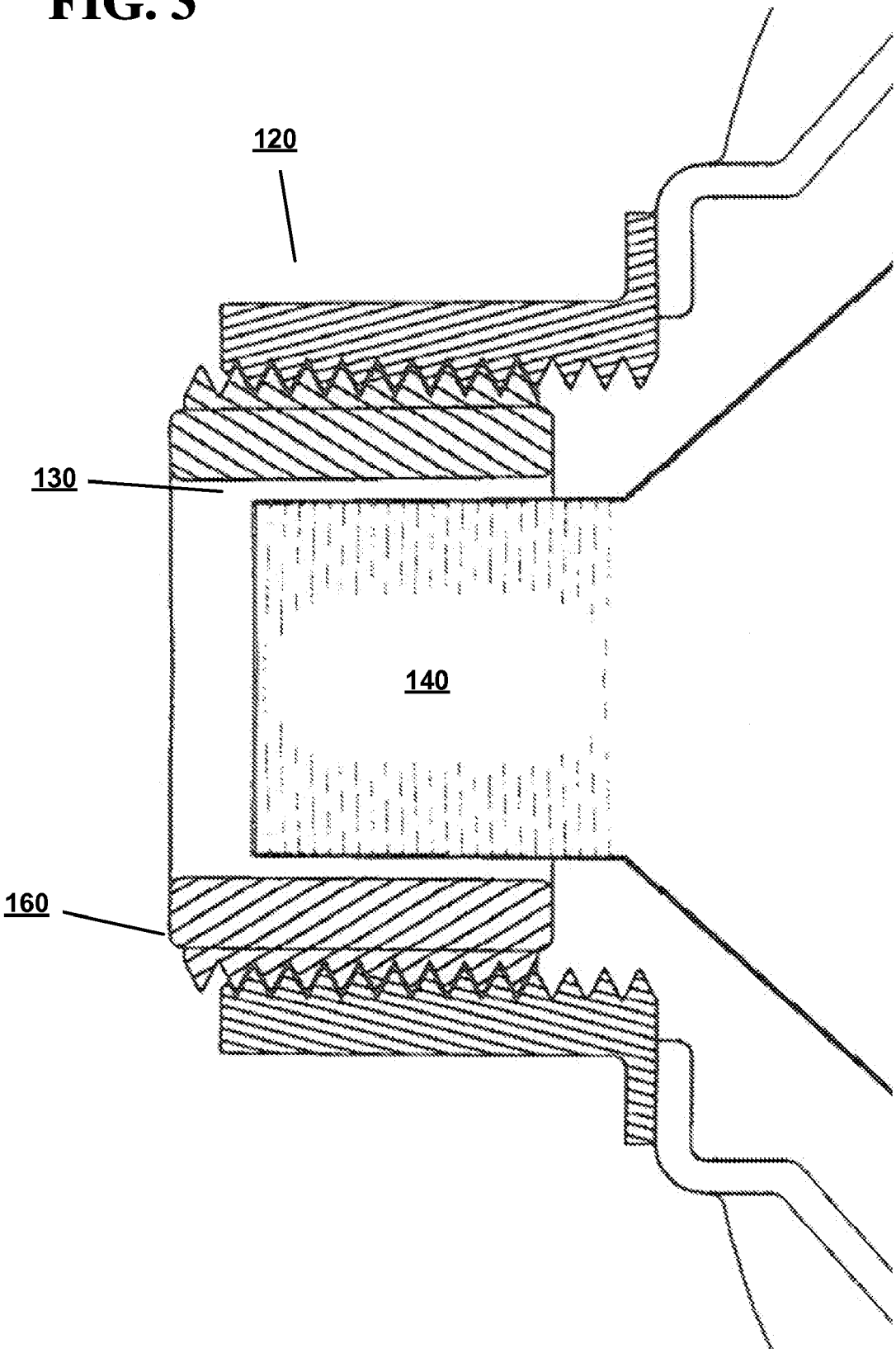
FIG. 3 shows a close-up schematic side view of an example of a moveable magnet disposed within a loudspeaker.

FIGS. 1 and 2 show a schematic side view of an example loudspeaker having a moveable magnet. FIG. 3 shows an enlarged side view of a moveable magnet assembly as shown in FIGS. 1 and 2. A loudspeaker 100 may include a speaker body or case 110 and a speaker cone assembly 150. The speaker cone assembly 150 may be attached to a piston 140, which may include a cylindrical core wrapped with wire. The core may be a permanent magnet, a magnetic material, or other suitable material. The speaker cone 150 may be attached directly to the piston 140, or may be connected partially or completely by way of an intervening structure, such as an inner suspension ("spider") structure as known in the art. The specific construction, configuration, and use of the body 100, cone assembly 150, and piston 140 will be readily understood by one of skill in the art.

The piston 140 may be disposed entirely or partially within a moveable magnet 160. As used herein, the piston may be described as "within" the moveable magnet when disposed at least partially in a region that is partially or entirely surrounded by the moveable magnet. For example, the moveable magnet may be annular or cylindrical, such that it defines an interior region of space that is surrounded by the magnet. An item, such as the piston, that is disposed in the region of space surrounded by the magnet may be describes as being disposed "within" the magnet. The moveable magnet may be separated from the piston by a gap 130, such as an air gap. The moveable magnet may be positionable relative to the piston by a user, such as by moving the moveable magnet 160 parallel to the axis of the piston 140. Moving the piston causes more or less of the piston 140 to be within the magnet 160. For example, FIG. 1 shows a moveable magnet with an outer thread 162 disposed within a threaded assembly 120 having a thread 122 that interlocks with the outer thread 162. In the illustrated configuration, when the magnet is turned counter-clockwise as viewed from the back of the loudspeaker (i.e., is unscrewed), it moves to the left of the illustrated loudspeaker, causing less of the piston 140 to be disposed within the magnet 160. When the magnet is turned clockwise, the magnet moves to the right, causing more of the piston 140 to be disposed within the magnet 160.

In general, as more of the piston 140 is disposed within the magnet 160, the sound pressure level produced by the loudspeaker 100 will be higher for a selected volume setting of the loudspeaker. In general, the volume setting of the loudspeaker may be selected independently of the magnet position. The mechanism for selecting and setting the volume of the loudspeaker may be the same as, equivalent to or comparable to typical volume selection mechanisms available in loudspeakers known in the art. The final or actual sound pressure level produced by the loudspeaker may be affected by the position of the magnet. For example, in some configurations or for some loudspeakers a higher volume setting may produce a warmer tone and/or a higher level of distortion. Most generally, the user may position the moveable magnet to produce a desired sound pressure level, without substantially or noticeably changing the tone/distortion of the produced sound.

In some configurations, the loudspeaker 100 may include a mechanism to indicate the relative position of the moveable magnet to a user of the loudspeaker. For example, the loudspeaker illustrated in FIG. 1 includes an arm 170 attached to the speaker frame via a pivot 175. As the moveable magnet 160 moves relative to the piston 140, the magnet causes the arm to pivot at the pivot point 175. The other end of the arm may, for example, include an indicator that moves across a indicator strip or scale 180 or other indication of the position of the moveable magnet. For example, the strip 180 may list measurements of the relative separation between the piston 140 and the magnet 160, i.e., how far the piston extends out of the magnet. The strip may also or alternatively indicate the relative effect of the position of the magnet, i.e., may indicate the sound pressure level resulting from the position of the magnet. As a specific example, the indicator may include a relative scale that indicates the relative position of the magnet, such as a scale with a lower limit (e.g., 0) resulting when the magnet is positioned at a maximum distance away from the front of the speaker, i.e., when a minimum amount of the piston is within the magnet, and a lower limit (e.g., 10 or 100) resulting when the magnet is positioned so that the maximum amount of the piston is disposed within the magnet. Similarly, the indicator may show the expected sound pressure level resulting from the associated position of the magnet. The arm 170 may be held against the magnet 160, such as via a spring assembly (not shown), or may otherwise be moveably attached to or in communication with the magnet. Other mechanisms and techniques may be used to indicate the relative position of the magnet, or to indicate the position of the magnet relative to the piston to a user of the loudspeaker.

In various configurations, the magnet 160 may be moveable to any suitable position relative to the piston 140, ranging from a first position in which little or substantially none of the piston is disposed within the magnet, to a second position in which most, all, or substantially all of the piston is within the magnet. In an embodiment, in the first position the magnet may be disposed at a farthest point to the rear of the speaker, i.e., away from the cone, and in the second position the magnet may be disposed at a farthest point to the front of the speaker, i.e., toward the cone. In the second position, the piston may be disposed entirely within the magnet, and the magnet may be prevented from moving farther toward the front of the speaker. Other arrangements may be used.

Figure 4:
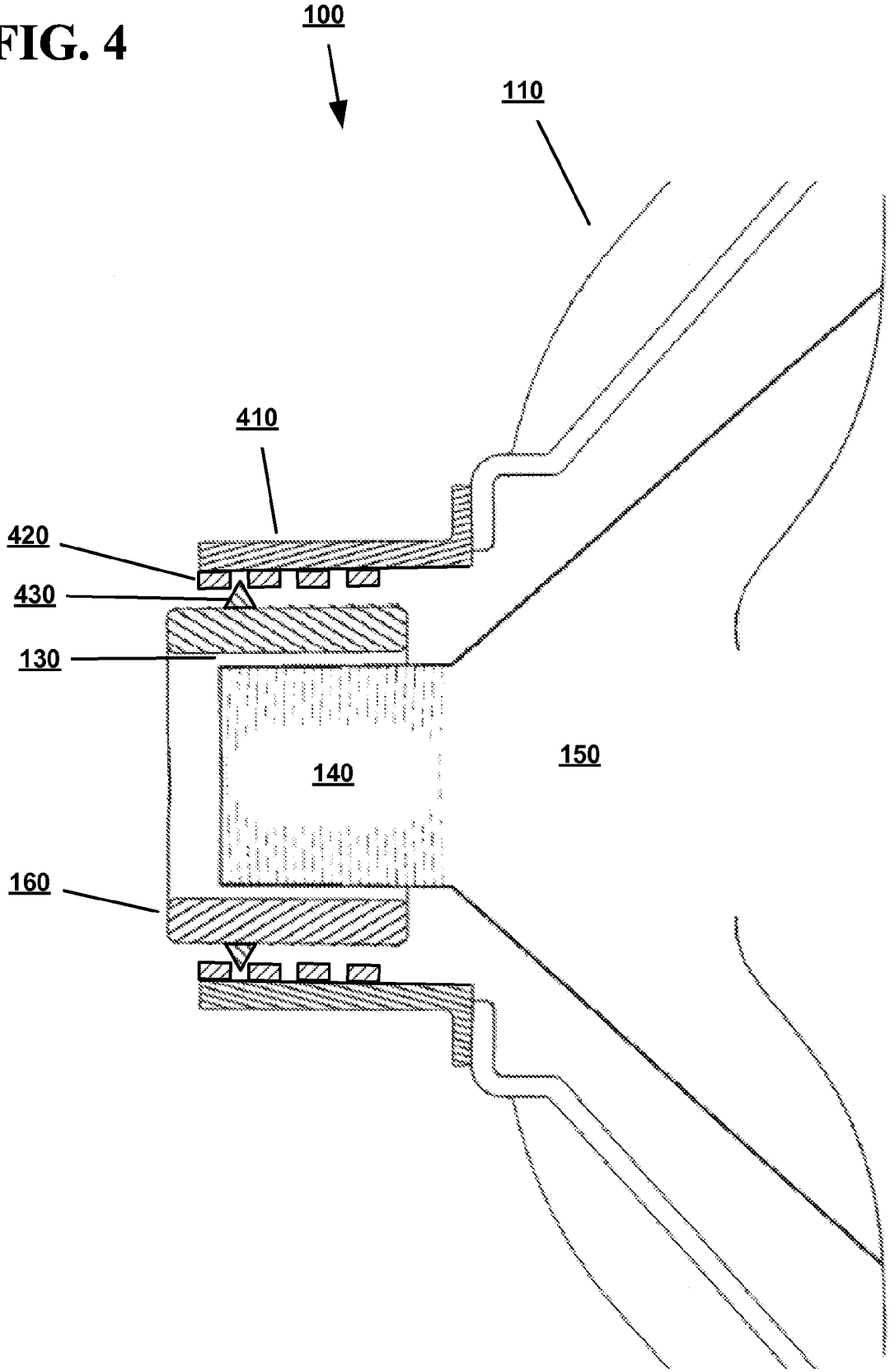
FIG. 4 shows a schematic side view of an example loudspeaker having a moveable magnet.

In some configurations, the magnet 160 and/or an assembly of the speaker body may include physical stops configured to place the magnet in pre-set positions relative to the piston. FIG. 4 shows an example of a loudspeaker with a moveable magnet that is configured to be placed in a plurality of positions. In the example, an outer assembly 410 includes a series of stops 420. The moveable magnet 160 includes extensions 430 that can be positioned between the stops 420. As a specific example, the magnet may be rotated so that the extensions 430 are not positioned between stops, for example so that the magnet is positioned such that a line defined by the extensions 430 is perpendicular to a line formed by opposite stops. A user may then slide the magnet relative to the piston, and rotate the magnet so that the extensions 430 are positioned between different stops. Other arrangement may be used to provide pre-set arrangements in which the magnet may be positioned. For example, referring to the configurations shown in FIGS. 1-3, the threads on the magnet and/or the outer assembly may include one or more notches or other physical features that allow for the magnet to be removeably positioned into specific locations relative to the piston.

The various features and arrangements described herein may be used in any appropriate combination or sub-combination as will be understood by one of skill in the art. For example, a position indicator such as the indicator strip and pivoting arm described with respect to FIG. 1 may be used in conjunction with a set of magnet stops, such as the stops and extension described with respect to FIG. 4. Other equivalent physical features and configurations may be used.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A loudspeaker comprising:

a speaker body;

a speaker cone disposed at least partially within the speaker body, the speaker cone having a narrow end and a wide end;

a cylindrical magnet disposed adjacent to the narrow end of the speaker cone, the cylindrical magnet moveable from a first position to a second position;

a piston connected to the narrow end of the speaker cone, the piston comprising:

a permanent magnet; and a wire wrapped around the piston;

a first portion of the piston being disposed within the cylindrical magnet when the cylindrical magnet is in the first position, and a second portion of the piston being disposed within the cylindrical magnet when the cylindrical magnet is in the second position, the first portion being larger than the second portion; and an indicator moveably connected to the cylindrical magnet, the indicator comprising:

an indicator strip; and a moveable arm in physical communication with the cylindrical magnet;

an end of the moveable arm being disposed in a first region of the indicator strip when the cylindrical magnet is in the first position, and in a second region of the indicator strip when the cylindrical magnet is in the second position, the indicator strip identifying the position of the cylindrical magnet relative to the piston.

2. The loudspeaker of claim 1, further comprising a magnet housing, the cylindrical magnet being disposed within the magnet housing, wherein the magnet housing and the cylindrical magnet comprise a plurality of stops, each stop defining a pre-set position in which the cylindrical magnet may be placed by a user of the loudspeaker.

3. The loudspeaker of claim 2, wherein the cylindrical magnet can only be positioned in the pre-set positions.

4. A device comprising:

an enclosure;

a speaker cone disposed at least partially within the enclosure;

an outer magnet; and a piston connected to the speaker cone and disposed at least partially within the outer magnet, the outer magnet being moveable from a first fixed position in which a first portion of the piston is disposed within the outer magnet, to a second fixed position in which a second portion of the piston is disposed within the outer magnet, the second portion being less than the first portion.

5. The device of claim 4, further comprising:

an indicator in physical communication with the outer magnet, the indicator configured to identify the position of the magnet relative to the piston to a user of the device.

6. The device of claim 4, wherein the outer magnet is positionable in each of a plurality of pre-set positions, wherein the device is configured to operate in each of the pre-set positions.

7. The device of claim 6, further comprising an assembly, the outer magnet being disposed within the assembly, the assembly comprising a plurality of stops corresponding to the pre-set positions, a portion of the outer magnet being moveable to each of the stops by a user of the device.

8. The device of claim 4, further comprising an assembly, the outer magnet being disposed within the assembly.

9. The device of claim 8, wherein the outer magnet is threaded, and the assembly comprises a threaded portion that matches the threads of the outer magnet, the outer magnet being positionable relative to the piston by rotating the magnet within the threads.

10. The device of claim 8, wherein the outer magnet is positionable relative to the piston by sliding the magnet within the assembly.

11. A device comprising:

an enclosure;

a speaker cone disposed at least partially within the enclosure;

an outer magnet;

a piston connected to the speaker cone and disposed at least partially within the outer magnet;

the outer magnet or the piston being moveable from a first preset position to a second preset position relative to the other, wherein the device is configured to operate in both the first preset position and the second preset position; and means for positioning the outer magnet relative to the piston so that more or less of the piston is disposed within the outer magnet.

12. The device of claim 11, wherein the means for positioning the outer magnet comprises a threaded assembly.

13. The device of claim 11, wherein the means for positioning the outer magnet comprises a plurality of stops, each stop defining a pre-set position of the magnet.

14. The device of claim 11, further comprising:

an indicator in physical communication with the outer magnet, the indicator configured to identify the position of the magnet relative to the piston to a user of the device.

15. The device of claim 11, wherein the outer magnet is positionable in each of a plurality of pre-set positions.

16. The device of claim 15, further comprising an assembly, the outer magnet being disposed within the assembly, the assembly comprising a plurality of stops corresponding to the pre-set positions, a portion of the outer magnet being moveable to each of the stops by a user of the device.

17. The device of claim 11, further comprising an assembly, the outer magnet being disposed within the assembly.

18. The device of claim 17, wherein the outer magnet is threaded, and the assembly comprises a threaded portion that matches the threads of the outer magnet, the outer magnet being positionable relative to the piston by rotating the magnet within the threads.

19. The device of claim 17, wherein the outer magnet is positionable relative to the piston by sliding the magnet within the assembly.

* * * * *